US010847288B2

(12) United States Patent
Bellora

(10) Patent No.: US 10,847,288 B2
(45) Date of Patent: Nov. 24, 2020

(54) HIGH FIDELITY FEEDTHROUGH SYSTEM

(71) Applicant: Anthony Bellora, San Diego, CA (US)

(72) Inventor: Anthony Bellora, San Diego, CA (US)

( * ) Notice: Subject to any disclaimer, the term of this patent is extended or adjusted under 35 U.S.C. 154(b) by 0 days.

(21) Appl. No.: 16/257,833

(22) Filed: Jan. 25, 2019

(65) Prior Publication Data

US 2020/0243227 A1 Jul. 30, 2020

(51) Int. Cl.
*H01B 19/00* (2006.01)
*H01B 17/30* (2006.01)
*C22C 5/08* (2006.01)

(52) U.S. Cl.
CPC ..... *H01B 17/305* (2013.01); *C22C 5/08* (2013.01); *H01B 19/00* (2013.01)

(58) Field of Classification Search
CPC ..... H01B 17/305
USPC ..... 174/650
See application file for complete search history.

(56) References Cited

U.S. PATENT DOCUMENTS 5,223,672 A * 6/1993 Pinneo ..... B23K 20/129 156/73.5
2004/0134427 A1* 7/2004 Derderian ..... C23C 16/4404 118/715
2004/0191621 A1* 9/2004 Heller, Jr. ..... H01M 2/065 429/181
2006/0247714 A1* 11/2006 Taylor ..... A61N 1/3754 607/36
2012/0290021 A1* 11/2012 Saurkar ..... A61N 1/37205 607/2
2016/0079001 A1* 3/2016 Lin ..... H01G 4/008 361/305
2017/0080130 A1* 3/2017 Pichler-Wilhelm ..... A61L 27/54
2019/0084871 A1* 3/2019 Mitra ..... C03C 3/253

* cited by examiner

*Primary Examiner* — Stanley Tso
(74) *Attorney, Agent, or Firm* — Michael L. Greenberg, Esq.; Greenberg & Lieberman, LLC

(57) ABSTRACT

A system for the manufacturing of high-fidelity insulated components is described. Per field requirements, components crafted via the process are hermetically sealed, and are configured to employ appropriately matched materials in accordance with their inherent properties of thermal expansion. A pin, glass insulator, and ferule are present. As opposed to conventional insulated components which employ stainless steel as an inefficient conductor, the unique matching process of the system provides for the use of copper and silver alloys to maximize efficiency while maintaining a hermetic seal. Specific glass is selected in accordance with the desired alloy in order to maintain similar degrees of expansion and contraction per temperature variations.

3 Claims, 6 Drawing Sheets

| Metal | Conductivity | Magnetic | Expansion | Cost Relative to Copper |
|---|---|---|---|---|
| Silver | 106 | N | 18.9 | 71 |
| Copper | 100 | N | 16.5 | 1 |
| Sterling Silver | 88 | N | 19.0 | 61.5 |
| Coin Silver | 85 | N | 18.2 | 60.5 |
| Gold | 76 | N | 14.2 | 9,137 |
| Aluminum | 63 | N | 23.5 | 0.53 |
| Rhodium | 38 | N | 8.2 | 6,720 |
| Zinc | 28 | N | 30.2 | 0.48 |
| Tungsten | 15 | N | 4.5 | 8.8 |
| Brass | 27 | N | 20 | 0.64 |
| Nickel | 24 | Y | 13.4 | 1.9 |
| Palladium | 16 | N | 11.8 | 6,553 |
| Platinum | 16 | N | 8.8 | 6,855 |
| Tin | 15 | N | 22.0 | 4.1 |
| Titanium | 4.1 | N | 8.6 | 12.6 |
| Kovar 47 | 4.0 | Y | 4.9 | 215.5 |

FIG. 3

| Manufacturer | Mix | Firing Temp | CTE |
|---|---|---|---|
| Corning | 7070 | 1068°C | 3.20 |
| Corning | 7052 | 1314°C | 4.70 |
| Corning | 7056 | 1324°C | 5.15 |
| Corning | 9013 | 1213°C | 8.85 |
| Corning | 0080 | 1285°C | 9.4 |
| Ceradyne-VIOX | 39703 | °C | 17.9 |
| Ceradyne-VIOX | 37903 | °C | 18.26 |
| Materials Research Group | DG-0091 | 600°C | 18.80 |
| Ceradyne-VIOX | V2315 | °C | 18.95 |
| Ceradyne-VIOX | V2316 | °C | 19.29 |
| Ceradyne-VIOX | 39704 | °C | 19.5 |

FIG. 4

| Pair | Conductor (C) | CTE | Insulator (I) | CTE | Expansion Differential (C-I/C)*(100%) |
|---|---|---|---|---|---|
| A | Kovar 47 | 5.1 | Corning 7070 | 3.20 | 59% |
| B | Kovar 47 | 5.1 | Corning 7052 | 4.7 | 8.5% |
| C | Sterling Silver | 19.0 | DG-0091 | 18.8 | 1.1% |
| D | Coin Silver | 18.2 | Viox 37903 | 18.28 | 0.3% |
| E | Titanium | 8.6 | Corning 9013 | 8.85 | -2.8% |

FIG. 5

HIGH FIDELITY FEEDTHROUGH SYSTEM

FIELD OF THE PRESENT INVENTION

The present invention relates to ideal material matching systems, and more specifically relates to a system for matching insulating materials to appropriate conductive elements for high electrical efficiency and hermetic glass to metal seal. The system shall be designed for high power radio applications to eliminate the generation of heat & Passive Intermodulation Products.

BACKGROUND OF THE PRESENT INVENTION

Many types of micro electro-mechanical devices are enclosed in electrically conductive packages that shield delicate construction from the environment. Conductive housing packages are used because they provide a shield from background radiation emissions and sturdy protection from damage. The affordable material of choice for package housing construction is light-weight aluminum, particularly in avionics. The devices inside of the aforementioned sealed package must receive signals via hermetic terminal ports known as feedthroughs. These terminals are fabricated separately and then soldered into custom shaped packages to provide conductive while still hermetic pathways to the internal circuitry.

The basic feedthrough is made by placing an insulating glass bead inside of a conductive steel ring. A similar steel terminal pin is pushed through the bead center hole. The ring, bead and pin are then fused together by heat making an assembly with concentric metal to glass to metal seals. Once bonded as a single assembly the exposed metal surfaces are plated with precious metals to accept soldering to the final package. When designing feedthroughs for radio circuits the diameters of the bead, ring & pin are selected to achieve a balanced, typically 50 impedance for efficient signal transmission through the portal.

This hermetic sealing system is predicated on the compatibility of both conductor and insulator in regard to the physical attribute of expansion/contraction with temperature. The careful matching of constituent material Coefficient of Thermal Expansion or CTE insures that the assembly will maintain seal integrity throughout a wide range of temperature extremes. The industry standard Kovar™ 42 steel conductor is closely matched to Corning™ 7070 glass. Though these materials will provide a hermetic glass to metal seal over a wide temperature range they sacrifice electrical performance for mechanical functionality. The steel required for this system is a poor conductor of electricity and exhibits magnetic properties. The higher resistivity of steel converts some electrical power to heat.

More importantly when AC signals are propagated across this material the magnetic properties create a second power reducing phenomenon. Additional energy is lost by the generation of signal distortions know as Intermodulation products (IMD). The resistive losses to heat are intensified through magnification of skin effect in magnetic conductors. All three phenomenon combine to create significant signal strength reduction, distortion and heat.

Thus, there is a need to create a high efficiency hermetic feedthrough system for radio applications without these common drawbacks. As magnetic steel is a poor choice for electrical conduction, designers must accept a certain power loss tax and signal noise when hermetic circuit packages are required. The secondary undesirable attribute is the low thermal expansion rate of the aforementioned terminal. Industry standard feedthroughs have ¼ expansion rate of favored aluminum housing material. The solder joints bonding these together endure high stress at temperature extremes since the materials do not shrink and grow together. The pliability of solder is not sufficient to absorb these stresses inducing microcracks with every temperature swing. These cracks grow over continual temperature cycling leading to joint fatigue and eventual seal failure. These feedthrough solder joints fail first under extensive low cycle fatigue, representing the service life limit for hermetic avionics.

Industry standard Kovar was designed as a blend of metals to match the then common 7070 glass. The strategy of this invention is to match glass to preferred metal conductor. The solution to overcome both poor signal fidelity and long term package integrity is to marry alternative high expansion materials which favor electrical performance. The primary design consideration will be high efficiency transmission of AC signals through the terminal. A thermally compatible insulator must be found that will bond to the conductor. The secondary goal will be finding both with high expansion to match that of common package metals.

SUMMARY OF THE PRESENT INVENTION

The present invention is a series of newly developed insulators and conductive terminals produced to withstand military airborne environments. The insulators are matched with appropriate highly-conductive metals which have similar expansion properties in order to insure a persistent hermetic seal.

The object of the present invention is to significantly increase electrical performance and reliability of airborne electro-mechanical devices over present seals.

Another object is to enhance power transmission economy through the use of highly conductive materials.

Another object is to enhance signal fidelity by use of nonmagnetic conductors.

Yet another object is to extend service life of electro-mechanical devices by reduction of thermal incompatibility between avionics packages and present technology feedthrough seals.

A further object is to design the highly efficient & reliable feedthrough system with commercially available materials to provide reasonable cost and availability.

Another object is that the feedthrough dimensions allow a 50Ω impedance to be presented from DC to 26 GHz.

BRIEF DESCRIPTION OF THE DRAWINGS

The present invention will be better understood with reference to the appended drawing sheets, wherein:

FIG. 3 displays a chart showing the various conducting metals as they relate to individual conductivity and ratings.

FIG. 4 displays a chart showing various insulating materials, and CTE progression of the present invention.

FIG. 5 displays a chart showing thermally matched conductors and insulators of the present invention.

DETAILED DESCRIPTION OF THE PREFERRED EMBODIMENT OF THE PRESENT INVENTION

The present invention is a system of thermal matching components for the construction of hermetic feedthroughs requiring high signal fidelity. The final assembly shall be interchangeable with present terminals for electromechanical device manufacturers. The starting point will be terminal pin and body that are ideal for radio signal transmission. Of primary consideration is conductivity of the pin. The best conductors of electricity are silver and copper. Any alloy combination of these two elements will have high conductivity and no magnetic properties. The secondary property will be the metal stiffness. The barrel must be stiff enough to endure fabrication & the pin must also be tolerant of package handling.

Materials

In construction of high performance feedthroughs, the primary property of the terminal should be high conductivity. Metals that can be magnetized should be excluded due to their adverse effects on signal integrity. Additionally, resistance to corrosion is necessary to eliminate the need for post plating with magnetic nickel. The third conductor consideration is minimum stiffness to ensure the terminal's ability to hold its shape.

The complimentary feedthrough component is the insulator. The thermally matched glass shall be bondable to candidate conductors. As such, the closest match in expansion properties is ideal. Additionally, the insulator should have low porosity which insures an atmospheric barrier across high pressure differentials. Likewise, the insulator preferably has a low loss tangent with a dielectric constant between 4 and 20 for acceptable RF design characteristics.

The feedthrough assembly shall have temperature expansion closer to aluminum than conventional feedthroughs made with Kovar 42 and Corning 7070 materials to enhance overall package reliability.

Process

Figure 2:
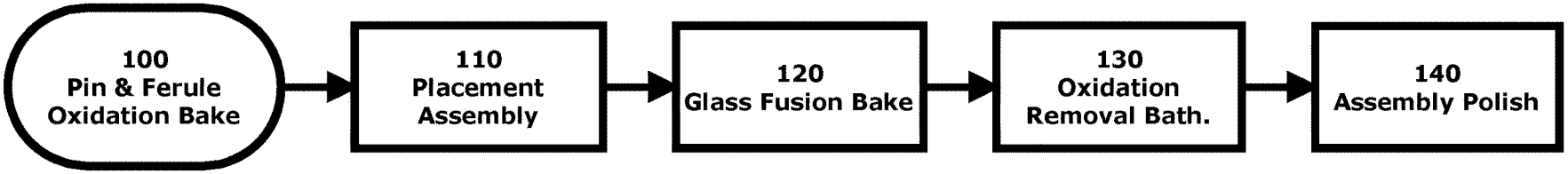
FIG. 2 exhibits a flow chart detailing the process of manufacturing and implementation of the present invention.
Figure 6:
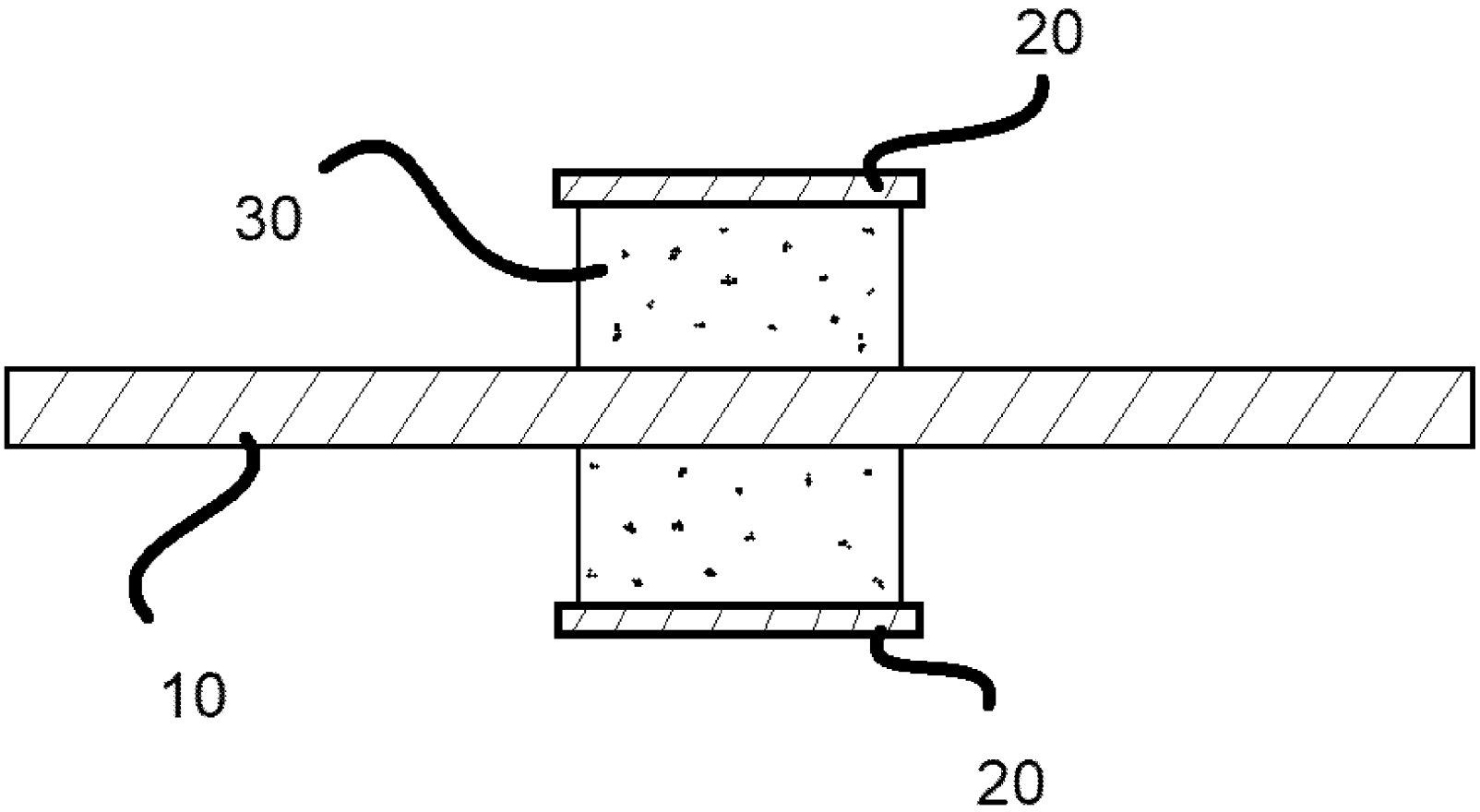
FIG. 6 exhibits a view of cross-matched materials by the system of the present invention.

The process of feedthrough manufacture starts with fusing one glass and the two metal pieces together. Selection of thermal matched candidates must be fused together; the critical aspect of conductor/insulator choice is bondability. In terms of manufacturing of such components, the pairing of an insulator to a conductor must form a strong enough bond to ensure a seal across a wide temperature range. Additionally, the melting points of the conductor and insulator must be within the range of industry process limits for feedthrough assembly. Terminal rings, beads and pins are initially hand placed together inside of a holding block or firing fixture. The group of feedthroughs in fixture are then sent through a conveyer belt firing oven at temperatures above 450° C. The parts are then cooled and cleaned of oxidation. The finished feedthroughs are ready for direct installation into customer packages. This process is depicted in FIG. 2.

Design

The present invention takes into account matching the best conductions with the closest expansion glass. Any metal with conductivity higher than baseline Kovar 42 with an International Annealed Copper Standard (IACS) of 4 would be considered advantageous. This includes the top 13 metals, per the chart shown in FIG. 2. Accordingly, the best conductor is pure silver, with an IACS rating of 106. The next closest conductor component is copper, with an IACS rating of 100. Following these are Gold (IACS rated 70), Aluminum (IACS rated 61), Platinum (IACS rated 16), Palladium (IACS rated 16) & Tin (IACS rated 15). Starting with the best conductor, Silver has the drawback of being too soft for withstanding manufacturing of durable terminals. Silver corrosion is not of primary concern as the oxide is conductive and easily removed. Copper provides superior strength but has a high corrosive tendency when exposed to water. Third on the list is Gold with IACS rated 84 with the drawbacks of high malleability and cost. The forth is Aluminum, which is very difficult to bond. Precious metals Platinum & Palladium are rare and therefore prohibitively expensive. The top 10 conductors are also nonmagnetic. The elements nickel (IACS rated 22), iron (IACS rated 17) and their alloys are highly magnetic and should not be considered. These materials and their corresponding features are depicted in FIG. 3.

Though none of the best conductors prove an ideal choice, a sufficient compromise can be found by alloying the top two elements silver and copper. The proper ratio of the two metals will achieve high conductivity, low magnetic permeability, sufficient strength and resistance to corrosion. There are two commercially available Ag/Cu alloys that have been developed for high luster and strength: sterling silver (Ag 92.5/Cu 7.5) for jewelry and coin silver (Ag 90/Cu10) for money. As such, insulators should fall within ±5% of conductor CTE to ensure a good seal.

The matching of insulators will be selections from the higher expansion glasses available in industry. The insulator known as DG-0091 from Materials Research Group™ has an ideal CTE of 18.8, which provides a match difference of <2% when paired with sterling. Glass insulators known to the industry are depicted in FIG. 4.

As a corollary, coin silver is best suited to be paired with Viox Ceredyne™ glass #37903. This alloy was developed with high strength to be used as circulated coinage. It has a CTE of 18.2 and the insulator has a CTE of 18.26. While this is a slightly superior match than sterling to DG-0091, both combinations will achieve the goals of providing a high electrical efficiency hermetic seal. Selecting materials in this manner for conductors enhances their manufacturability, as they are directly solderable without the need for post plating.

The ideal matched pairs used in the manufacturing of the component via the system of the present invention, is depicted via a table in FIG. 5.

Figure 1:
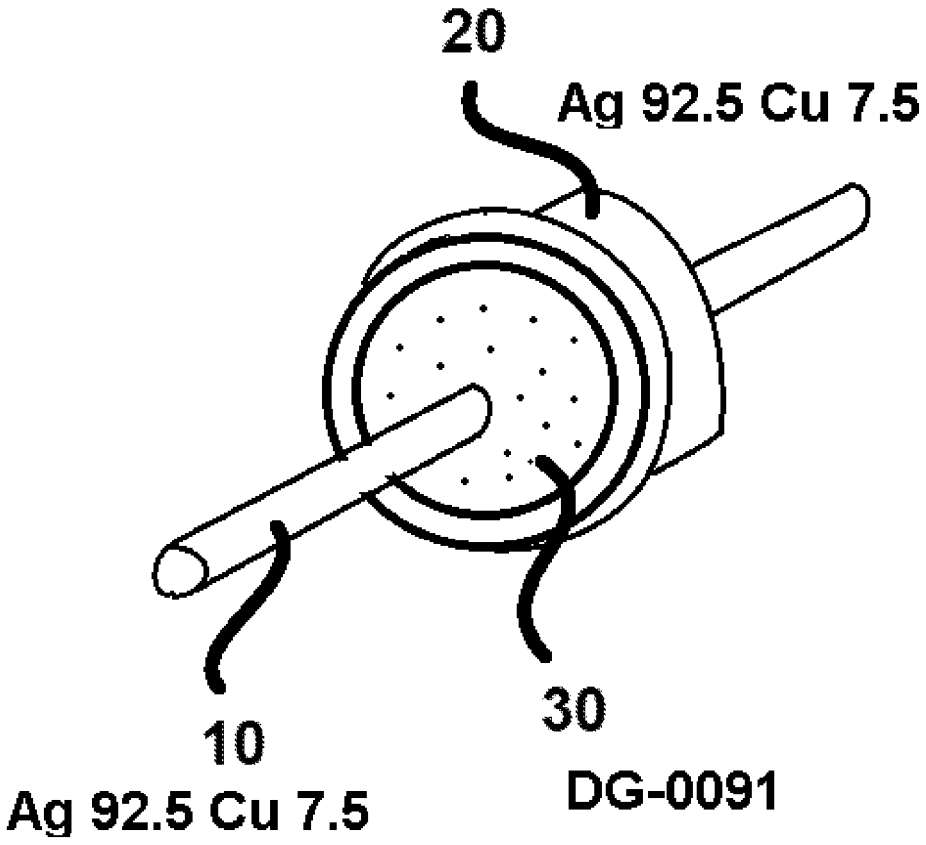
FIG. 1 depicts a view of a isometric feedthrough manufactured with the material matching system of the present invention.

It should be understood that the present invention is a system of matching ideal materials to their respective components. The components employed include a pin (10), a ferule (20), and a glass (30). Similarly, it should be understood, per convention, that the glass (30) is originally a glass bead, which, during the manufacturing process of the present invention, is changed from the original bead shape to the final insulator shape as shown in FIG. 1.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application. That being any conductor alloy comprised of any Copper, Silver, and/or Titanium. It should be understood that the alloy of the pin (10) has a higher conductivity than traditional pins presently used in such components which are commonly made of steel, or occasionally aluminum. As such, the present invention presents a superior mechanism by which transmissions and/or current may be conveyed across a hermetic sealed component.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A system of matching conductive materials to corresponding insulators in accordance with their inherent expansion properties for use in wireless radio components connected to alternating current signals in an airborne environment comprising:

oxidation baking a pin and a ferule of the component;

wherein the pin and ferule are solely composed of silver and copper combinations;

placing appropriate glass bead in a desired position as an insulator around the pin and ferule;

fusion baking the glass between the pin and ferule, creating a hermetic seal, ensuring no compression fit is necessary;

placing the assembled glass, pin, and ferule into an oxidation removal bath, removing all oxidation from the fusion baking;

polishing the finished component; and wherein the insulator is composed of a glass having CTE which provides a match difference of less than 2% of conductor CTE.

2. The system of claim 1, wherein the pin and ferule of the component are composed of an alloy that is non-magnetic.

3. A sealed conductor apparatus capable of maintaining a hermetic seal even when expanded and contracted in airborne environments including those over 50,000 feet comprising:

a pin, said pin solely composed of any combination of silver and copper;

wherein said combination of silver and copper are non-magnetic;

a glass material;

a ferule, said ferule composed of an alloy that solely contains any combination of Copper and/or Silver;

wherein said glass material is an insulator disposed around said pin, between said ferule; and wherein said glass material is composed of a glass having a CTE within 2% of conductor CTE.

* * * * *